US006499667B1

(12) United States Patent
Rhodes et al.

(10) Patent No.: US 6,499,667 B1
(45) Date of Patent: Dec. 31, 2002

(54) PRELOADING RAIL CLIPS IN STEEL SLEEPERS

(75) Inventors: David Rhodes, Lindford (GB); David John Gosling, Kingswood (AU)

(73) Assignee: Pandrol Limited, Addlestone (GB)

( * ) Notice: Subject to any disclaimer, the term of this patent is extended or adjusted under 35 U.S.C. 154(b) by 0 days.

(21) Appl. No.: 09/856,013

(22) PCT Filed: Nov. 17, 1999

(86) PCT No.: PCT/GB99/03833

§ 371 (c)(1),
(2), (4) Date: May 16, 2001

(87) PCT Pub. No.: WO00/31343

PCT Pub. Date: Jun. 2, 2000

(30) Foreign Application Priority Data

Nov. 23, 1998 (AU) ..... 7260

(51) Int. Cl.[7] ..... E01B 9/38
(52) U.S. Cl. ..... 238/264
(58) Field of Search ..... 238/264, 310, 238/315

(56) References Cited

U.S. PATENT DOCUMENTS 4,967,954 A * 11/1990 Von Lange ..... 238/310
5,083,706 A * 1/1992 Bratchell ..... 238/265

FOREIGN PATENT DOCUMENTS

| | | |
|---|---|---|
| DE | 4116306 | 11/1992 |
| GB | 2228958 | 9/1990 |
| GB | 2316702 | 3/1998 |

* cited by examiner

*Primary Examiner*—S. Joseph Morano
*Assistant Examiner*—Robert J. McCarry, Jr.
(74) *Attorney, Agent, or Firm*—Norbert P. Holler

(57) ABSTRACT

In a railway sleeper assembly, a pair of rail insulators (3) designed for use with a steel railway sleeper (1) which includes at the opposite sides of each intended rail location thereon a pair of openings (6) for receiving the respective stems (8) of a pair of shoulders (4), are each operatively disposed, when in use, between a foot of the rail (2) and the respective proximate shoulder (4). Each insulator (3) includes a member (11) which, when the insulator is in use, operatively extends below a top surface of the sleeper (1) and into the associated opening (6) so as to lie between the walls of that opening (6) and the stem (8) of the associated shoulder (4), thereby to retain the shoulder (4) in its operative position relative to the sleeper. The insulators (3), the shoulders (4) and a pair of rail clips (5) are preloaded onto, and are preassembled with, the sleeper (1) at a location remote from the track site, such that the entire assembly, with the rail clips (5) mounted in a preload position on the shoulders (4), can then be transported as a unit to the track site while the various components are retained on the sleeper (1) in their operative positions and are secure against falling off the sleeper (1) during transit of the assembly to the track site.

6 Claims, 4 Drawing Sheets

PRELOADING RAIL CLIPS IN STEEL SLEEPERS

This invention relates to preloading rail clips and insulators into steel railway sleepers.

Steel railway sleepers have been widely used for many years and are usually either formed from strip steel or rolled at the steel mill with an appropriate cross section. The steel thickness is usually in the range of 6–12 mm. Shoulders are attached to the sleeper to provide abutments to locate the rails so that the correct rail gauge width can be maintained. Usually these shoulders also serve as mountings for fasteners which hold the rail down. The fasteners may be ordinary bolts or resilient spring clips.

Many different means have been used to fix the shoulders in place. These include bolts and nuts, welding, deforming the top of the sleeper to form a rail abutment for use with clips which fit in pierced holes in the top sleeper surface, and shoulders which hook into holes in the top sleeper surface. However, in actual track use there have been many problems such as nuts continually coming loose, sleeper cracking around the edges of shoulder welds, sleeper cracking adjacent to deformed abutments which create locally stiff regions, and sleeper cracking from the edges of holes pierced in high stress areas.

One of the most successful methods of attaching the shoulder is where the shoulder hooks into a round hole near the lateral centre of the sleeper top where the stresses are relatively low. The highest stresses are near the lateral edges of the sleeper top where the stiffness is greatest. In shoulders of this type, projecting below the shoulder top there is a generally circular stem having a hook and a spur extending from the bottom of it. In use, the hook extends towards the rail and the spur extends away from the rail.

The hook type fastening as described is prior art and generally works well. However, it has one major disadvantage in that clips cannot be preloaded in the shoulders in a parking position prior to the rail being installed.

An important issue for railways is the reduction of labour costs associated with laying new track and replacing rails in existing track.

One way of obtaining significant labour cost reductions is to preload the clips, insulators, and rail pads into the new sleepers at the sleeper manufacturing plant so that when the sleepers are placed in track it is only necessary to drop the rail in place and mechanically push the rail clips into their final position.

This feature of preloading clips is known for concrete sleepers, but it is not possible for hook-in shoulders for steel sleepers because the shoulders are not actually locked in the sleeper until the rail and insulators are in place. Consequently, there is a good chance that if it was attempted to press the clips in place without the rail in position, the shoulder would come out of the hole in the sleeper. Even if it were possible to pre-install the clips in the shoulders, the shoulders could still bounce out of the holes from the impact of shunting and other shocks received while on the rail trucks en route to the track installation site.

Pre-loading costs much less than distributing the pads, insulators and clips along the track then manually placing the components in place and introducing the clips into the shoulders by hand. Obviously, this is not an efficient process and in addition the labour costs are high because of lost time in moving workers to and from the moving work site plus the limited track access times.

At the sleeper plant it is possible to largely mechanise the preloading of the components since it is a fixed and easily controlled environment.

Accordingly, it is desirable to allow clips, insulators and shoulders to be preloaded into a steel sleeper, and to be retained there during transport to the desired site for track work.

According to one aspect of the present invention there is provided a preloaded sleeper assembly including a steel railway sleeper having two shoulder mounting openings for each rail, and associated with each mounting opening, in combination, a shoulder including a hook and a spur inserted through the opening and located in an operative position, an insulator located on said shoulder on the side near the intended rail position, and a rail clip mounted on said shoulder;

characterised in that the said insulator includes a member which extends into the mounting opening so as to lie between the walls of said opening and said shoulder and thereby prevent movement of the shoulder towards the intended rail position, the rail clip being mounted on said shoulder in a parking position, so that the shoulders, insulators and clips are retained on said sleeper.

Thus, an embodiment of the present invention provides a new mounting arrangement, in which the insulator includes a projection or spigot extending into the opening in the sleeper.

This projection serves to prevent relative movement of the sleeper and shoulder, so that in transit the shoulder, insulator and clip assembly does not come loose from the sleeper. This enables a preloaded sleeper to be prepared, which can then be placed on the intended track ready for the rail to be fixed. This provides a considerable saving in labour over earlier proposals.

Preferably, the opening in the sleeper is circular or oval in shape.

Preferably, the shape of the member of the insulator is such as to substantially fill the cavity in the opening caused by the difference in size between the opening and the part of the shoulder passing through the opening.

In a preferred embodiment, the insulator is retained on the shoulder by means of a pair of recesses for receiving a corresponding pair of flanges or wings on said shoulder.

According to a further aspect of the present invention there is provided a method for preloading a steel railway sleeper with shoulders, rail clips and insulators, said sleeper including two shoulder mounting openings for each rail, said shoulder including a hook and spur, said method including the steps of:

a) inserting said shoulder into said opening and rotating it, so that the hook lies toward the intended rail position and the spur away from it;

b) locating said insulator onto the shoulder on the side near the intended rail position, said insulator including a projection which extends into the mounting opening so as to prevent movement of the shoulder towards the intended rail position;

c) driving said rail clip into a preload parking position, such that the shoulder, insulator and clip are retained on said sleeper.

Preferably, the step of locating the insulator onto the shoulder includes sliding the insulator over a pair of flanges on the shoulder, to be slidably received in corresponding recesses in the insulator.

The insulator may be retained in its located position by the preloaded and parked clip engaging the insulator in that position.

Reference will now be made, by way of example, to the accompanying drawings, in which.

Figure 1:
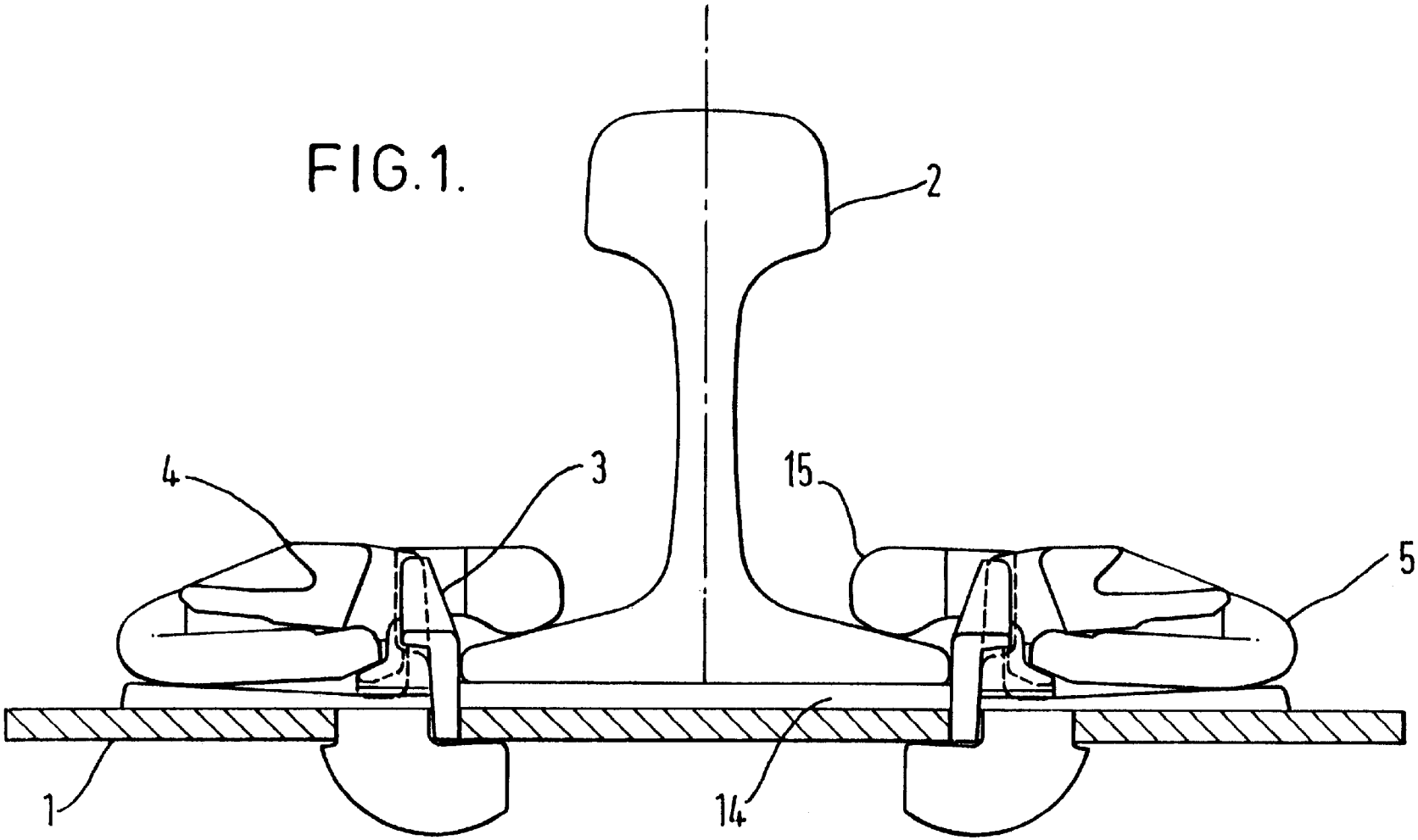
FIG. 1 shows a general cross-sectional view through the longitudinal axis of a sleeper and rail assembly embodying the present invention.

A representation of a completed rail assembly embodying the present invention with a rail 2 resting on a sleeper 1 is shown in FIG. 1. To secure the rail 2 to the sleeper 1, use is made of connection elements on each side of the rail. Each connection element is made up of a shoulder 4 and a spring clip 5.

Because in many cases (for signal purposes), rail 2 is electrified, insulators are used to isolate the live rail from other sections. In particular, insulating pad 14 isolates sleeper 1 from rail 2, shoulder insulator 3 isolates the shoulder 4 from the lower edge face of rail 2, and clip toe insulator 15 isolates shoulder 4 from an upper face of rail 2. It can be seen that in accordance with an embodiment of the invention, shoulder insulator 3 has a downwardly projecting spigot 11 (FIG. 5) fitting into the opening in the sleeper between the shoulder 4 and the rail 2.

Figure 2:
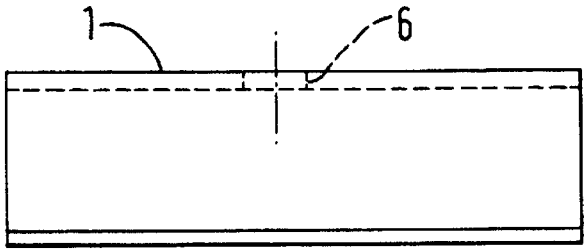
FIG. 2 shows a side view of a part of the steeper of FIG. 1.
Figure 3:
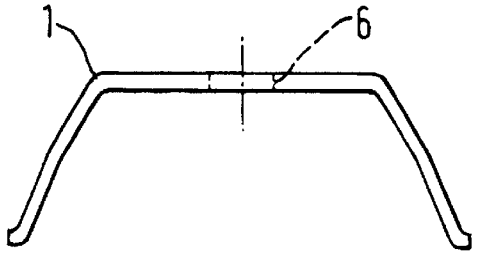
FIG. 3 shows an end view of the sleeper of FIG. 1.
Figure 4:
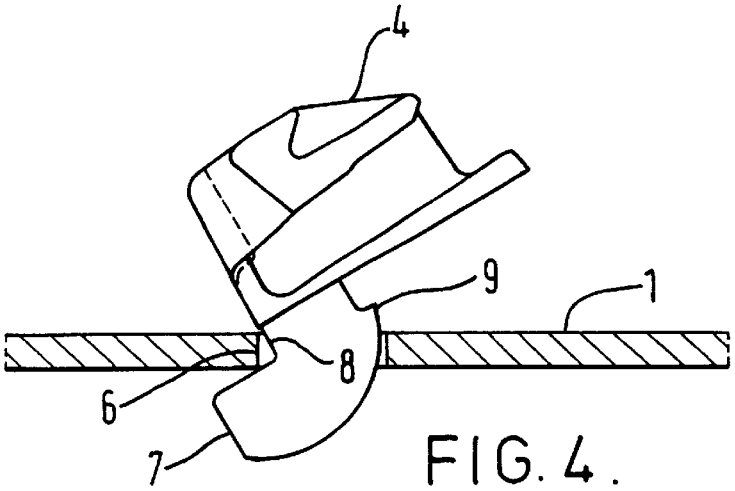
FIG. 4 shows a section through the top of the sleeper showing a shoulder with a shoulder hook being threaded through a sleeper hole.

The sleeper 1 has a circular hole 6 (FIGS. 2 and 3) to receive a hook 7 of shoulder 4, as shown in FIG. 4. Hole 6 must be large enough for the stem 8 and spur 9 of hook 7 to be received. The shoulder 4 is inserted in hole 6 by tilting the top towards the position where the rail will sit (left hand side in FIG. 4), then feeding hook 7 through hole 6 and moving the shoulder as far as possible towards the intended rail position. Next, the shoulder 4 is rotated back to its normal position with the base of the shoulder top sitting flat on the top of sleeper 1. During this action spur 9 will pass through the hole 6 in sleeper 1. Finally, the shoulder is moved as far back as possible from the intended rail position which causes spur 9 to engage the underside of sleeper 1 adjacent hole 6.

Figure 5:
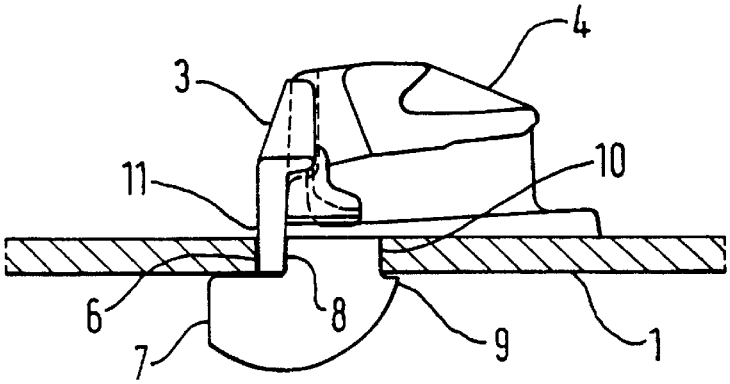
FIG. 5 shows the shoulder in its final position in the hole.

Shoulder insulator 3 is then put into place on shoulder 4 as shown in FIG. 5. Downwardly extending spigot 11 fits into the space remaining between stem 8 and sleeper 1, thus retaining shoulder 4 in place against a sleeper contact point 10.

Figure 6:
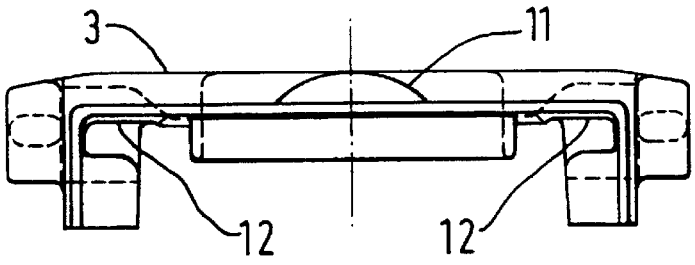
FIG. 6 shows a view looking upwards at the bottom of an insulator embodying the present invention.
Figure 7:
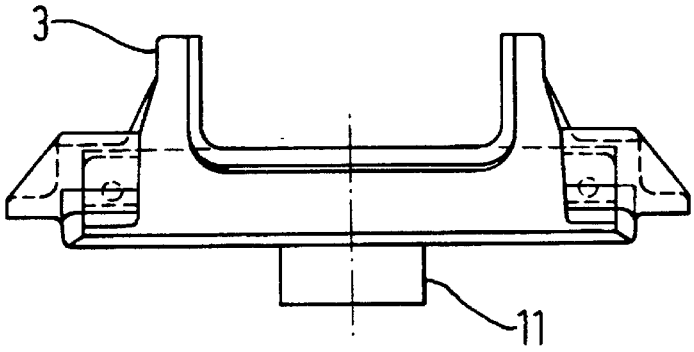
FIG. 7 shows a side elevation of the insulator showing the central spigot.

The shoulder insulator 3 with its spigot 11 is shown in various views in FIGS. 6 and 7. The shape of spigot 11 is such as to match the available space in hole 6 to substantially fill it. Conveniently, hole 6 is circular, although holes of other shapes are possible. The shoulder stem 8 and spigot 11 would then be shaped to fit into such a hole of different shape. For example, hole 6 could be oval, with a substantially matching oval stem 8. One advantage of this would be in limiting the amount the shoulder and preloaded clip assembly could rotate prior to fitting the rail, thus ensuring an easy assembly of the rail on site. The hole 6 and matching stem 8 could also be square or pentagonal, but it is desirable to avoid any sharp corners which act as stress concentrators.

Recesses 12 in insulator 3 are provided to slide downwards over wings on the shoulder 4 and restrain the insulator 3 in all directions except vertically. Alternatively, insulator 3 could be held in place by the clip 5 sitting, in the preload position, on a part of the insulator 3.

Figure 8:
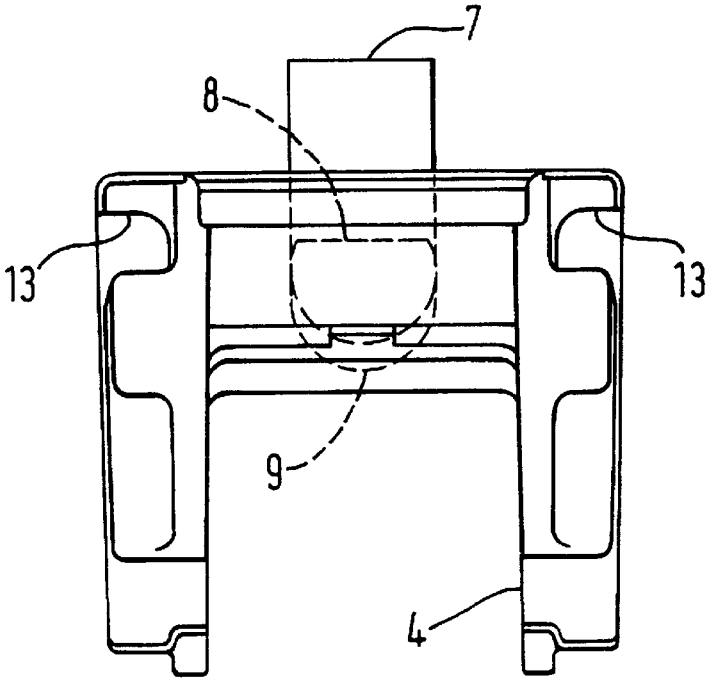
FIG. 8 shows a plan view of the shoulder.

FIG. 8 shows the shoulder 4 with hook 7, stem 8 and spur 9. Also shown are side wings 13 which are received in corresponding recesses 12 in insulator 3.

Figure 9:
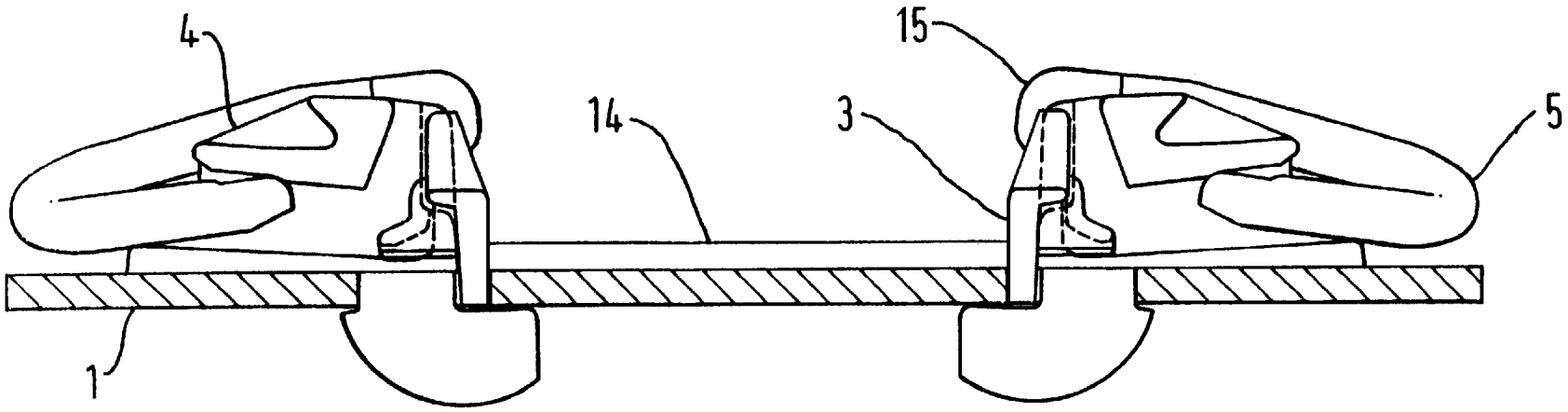
FIG. 9 shows a sleeper rail seat with all components preloaded in place in readiness to receive the rail.

In FIG. 9, there is shown part of a sleeper with all components preloaded in place to receive a rail. The entire assembly can thus be preloaded in the factory by automated processes, and transported to the site where the rail is to be laid. Once laid in position, spring clip 5 is simply pushed into its final position using conventional mechanical systems to secure the assembly to the rail. This final state is as shown in FIG. 1.

The feature of being able to preload or park the clips is also useful when replacing rails in track since the machine for removing the clips can be made to move the clips to the preload position instead of completely removing them. This means that after the rail is replaced it is only necessary to use the clip fitting machine to push the clips back into their final position, thus saving the manual labour required to pick the clips and other components up from the side of the track.

What is claimed is:

1. A preloaded railway sleeper assembly including a steel railway sleeper adapted to support two rails at respective intended positions thereon, and further including a plurality of shoulders adapted to be mounted in twos on said steel sleeper at opposite sides of each intended rail position, a plurality of insulators located each on an associated one of said shoulders at a side of that shoulder proximate to an associated one of said intended rail positions, and a plurality of rail clips each mounted on a respective one of said shoulders;

said railway sleeper assembly being characterized in that:

(a) said steel sleeper has, at opposite sides of each intended rail position, two shoulder mounting openings;

(b) each of said shoulders has a stem which is inserted into said steel sleeper through the associated one of said shoulder mounting openings and defines a hook and a spur, said hook and spur, when their associated stem is so inserted and appropriately oriented, being located at an underside of said steel sleeper and inhibiting extraction of said associated stem from said associated shoulder mounting opening;

(c) each of said insulators includes a member which, when that insulator is mounted on the associated shoulder, extends into the associated shoulder mounting opening so as to lie between respective walls of that shoulder mounting opening and said stem of said associated shoulder for preventing movement of that shoulder towards the associated intended rail position; and (d) each of said rail clips is mounted on a respective one of said shoulders and is retained on that shoulder in a preload position;

(e) whereby when said shoulders, said insulators and said rail clips are assembled with said steel sleeper, they are securely retained on said steel sleeper against falling off during transit of the entire railway sleeper assembly as a unit to a track site for installation.

2. An assembly as claimed in claim 1, wherein each said shoulder mounting opening in said steel sleeper is circular or oval in shape.

3. An assembly as claimed in claim 1 or 2, wherein said stem of each said shoulder is cross-sectionally smaller in size than said associated shoulder mounting opening, and said member of each said insulator is of such a shape and size as to substantially fill a cavity in said associated mounting opening that is caused by the difference in size between said associated shoulder mounting opening and said stem of said associated shoulder passing through that opening.

4. An assembly as claimed in claim 3, wherein each said insulator further comprises a pair of recesses for receiving a corresponding pair of flanges or wings provided on said associated shoulder, said recesses and said corresponding flanges or wings when interengaged with one another enabling the respective insulator to be retained on said associated shoulder.

5. A method of preparing a preloaded railway sleeper assembly which includes a steel railway sleeper adapted to support two rails at respective intended positions thereon, and which further includes a plurality of shoulders adapted to be mounted in twos on said steel sleeper at opposite sides of each intended rail position, a plurality of insulators located each on an associated one of said shoulders at a side of that shoulder proximate to an associated one of said intended rail positions, and a plurality of rail clips each mounted on a respective one of said shoulders;

said method comprising the steps of:

a) providing said steel sleeper, at opposite sides of each of said intended rail positions, with two shoulder mounting openings each designed for receiving a stem of an associated shoulder, which stem defines a hook and a spur adapted to engage an undersurface of said steel sleeper laterally of the associated shoulder mounting opening;

b) inserting said stem of each said shoulder into its respective shoulder mounting opening and rotating that shoulder so that said hook thereof when engaging said undersurface of said steel sleeper is oriented towards the associated intended rail position and that said spur of that shoulder when engaging said undersurface of said steel sleeper is oriented away from said associated intended rail position;

c) locating each said insulator onto the respective shoulder on the side of that shoulder proximate to said associated intended rail position, each said insulator including a member which extends into said associated shoulder mounting opening so as to lie between respective walls of said associated shoulder mounting opening and said respective shoulder for preventing movement of that shoulder towards said associated intended rail position; and d) driving each said rail clip into a preload position on a respective one of said shoulders, such that said shoulders, said insulators and said rail clips are securely retained on said steel sleeper against falling off during transit of the entire railway sleeper assembly to a track site for installation.

6. A method as claimed in claim 5, wherein each said insulator is retained in its located position on the associated shoulder by the associated rail clip when the latter has been driven into its preload position and is in engagement with that insulator in said located position of said insulator.

* * * * *